US008708438B2

(12) United States Patent
Zhao et al.

(10) Patent No.: US 8,708,438 B2
(45) Date of Patent: Apr. 29, 2014

(54) PRINTER HAVING ENERGY STORAGE DEVICE

(75) Inventors: Yu Zhao, Singapore (SG); Tong Nam Samuel Low, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 133 days.

(21) Appl. No.: 13/195,075

(22) Filed: Aug. 1, 2011

(65) Prior Publication Data

US 2013/0033532 A1 Feb. 7, 2013

(51) Int. Cl.
*B41J 29/38* (2006.01)

(52) U.S. Cl.
USPC ..... 347/5; 347/9; 363/89

(58) Field of Classification Search
USPC ..... 347/5, 9, 14; 363/61, 89
See application file for complete search history.

(56) References Cited

U.S. PATENT DOCUMENTS 6,275,397 B1 * 8/2001 McClain ..... 363/89
7,255,410 B2 * 8/2007 Masuda ..... 347/5
7,313,341 B2 12/2007 Matsusaka
7,583,910 B2 9/2009 Matsumoto et al.
7,675,196 B2 3/2010 Kimura
7,732,947 B2 6/2010 Watanabe et al.
7,734,937 B2 6/2010 Yano et al.
2004/0145926 A1 * 7/2004 Kanouda et al. ..... 363/61
2007/0211096 A1 * 9/2007 Narushima et al. ..... 347/14

FOREIGN PATENT DOCUMENTS

JP 9298873 * 11/1997
JP 2001045678 * 2/2001

OTHER PUBLICATIONS

Y Paul Rako, Supercapacitor powers LED flash, EDN, Jan. 8, 2008, 2 pages.

* cited by examiner

*Primary Examiner* — Lam S Nguyen

(57) ABSTRACT

A printer includes an energy storage device and a charger for charging the energy storage device and for providing a first DC voltage. The printer includes a first DC-to-DC voltage converter for converting the first DC voltage to a second DC voltage. The printer includes first printer electronics powered by the second DC voltage.

12 Claims, 6 Drawing Sheets

PRINTER HAVING ENERGY STORAGE DEVICE

BACKGROUND

Conventional printer power systems are designed for each printer based on the power needs of each printer. The printer power systems are also designed to comply with energy related regulations or standards, such as Energy Star. An inkjet printing system may include a printhead, an ink supply that supplies liquid ink to the printhead, and an electronic controller that controls the printhead. The printhead ejects drops of ink through a plurality of nozzles or orifices toward a print medium, such as a sheet of paper, to print onto the print medium. Typically, the orifices are arranged in one or more columns or arrays such that properly sequenced ejection of ink from the orifices causes characters or other images to be printed upon the print medium as the printhead and the print medium are moved relative to each other by using a motor. Inkjet printing systems have a highly dynamic electrical and mechanical system, which uses high pulses of current for driving the motor and for driving the printhead to eject the drops of ink.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
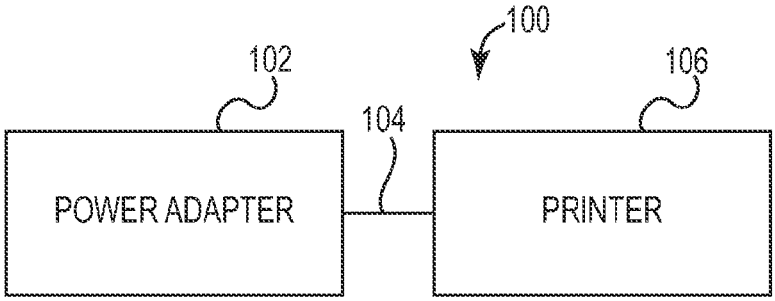
FIG. 1 is a block diagram illustrating one example of a printing system.

FIG. 1 is a block diagram illustrating one example of a printing system 100. Printing system 100 includes a power adapter 102 and a printer 106. Power adapter 102 is electrically coupled to printer 106 through a line 104. In one example, printer 106 is an inkjet printer that includes a highly dynamic electrical and mechanical system that uses high pulses of current for driving a motor and a printhead. In one example, power adapter 102 is an AC-to-DC voltage converter that converts an inputted AC voltage (e.g., 120V AC or 240V AC) to a DC voltage to power printer 106 through line 104. In another example, power adapter 102 converts an inputted DC voltage from a suitable source, such as Power over Ethernet (PoE) or PoE+, to a DC voltage to power printer 106 through line 104.

Power adapter 102 charges an energy storage device within printer 106. The energy storage device within printer 106 enables peak and short term printing power needs to be supplied by the energy storage device rather than by power adapter 102. The energy storage device within printer 106 is selected and sized to provide power to printer 106 during peak load conditions. Power adapter 102 charges the energy storage device within printer 106 independent of the selection and/or size of the energy storage device.

Power adapter 102 provides improved energy savings and power performance including higher efficiency for both printer 106 sleep mode and active mode power conversion. In one example, power adapter 102 has a power factor greater than 0.9. In one example, power adapter 102 provides substantially 12 volts DC and up to substantially 30 watts on line 104. Printer 106 converts the 12 volts DC to a plurality of other DC voltages for powering various components of printer 106. In this way, a single power adapter 102 may be used with a plurality of different printers having different peak and short term printing power needs.

Figure 2:
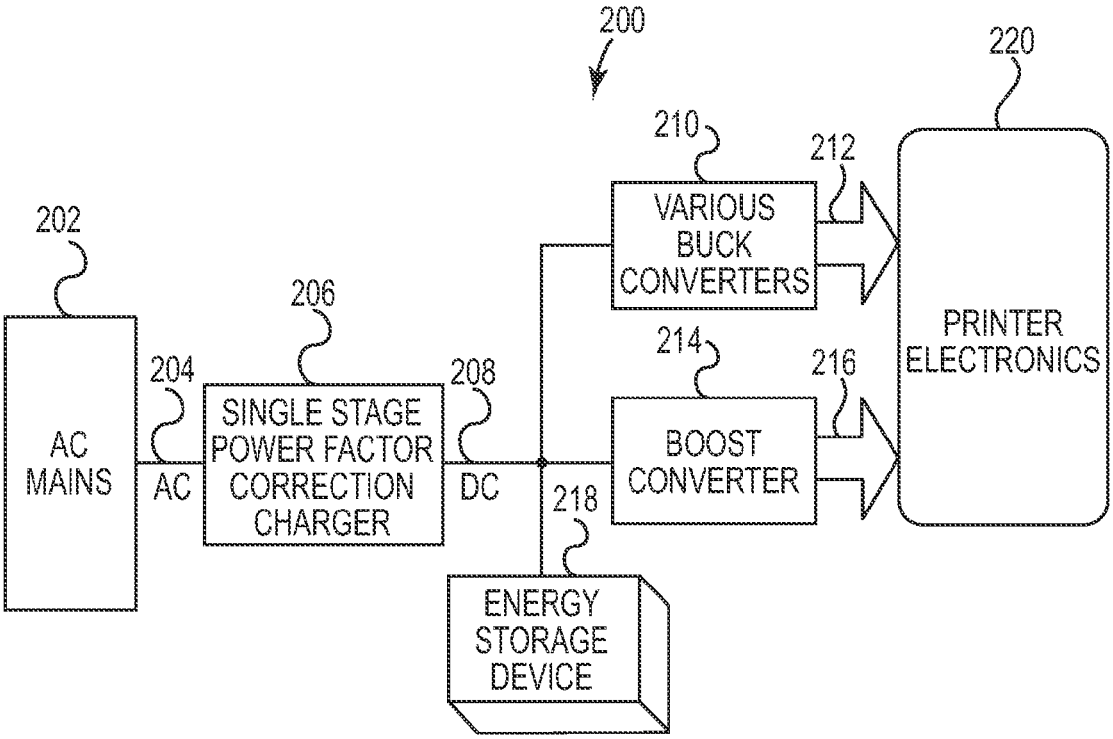
FIG. 2 is a block diagram illustrating one example of a universal power architecture for a printing system.

FIG. 2 is a block diagram illustrating one example of a universal power architecture 200 for a printing system, such as printing system 100 previously described and illustrated with reference to FIG. 1. Universal power architecture 200 includes AC mains 202, a single stage power factor correction charger 206, various buck converters 210, a boost converter 214, printer electronics 220, and an energy storage device 218. AC mains 202 are electrically coupled to single stage power factor correction charger 206 through AC line 204. Single stage power factor correction charger 206 is electrically coupled to various buck converters 210, boost converter 214, and energy storage device 218 through DC line 208. Various buck converters 210 are electrically coupled to printer electronics 220 through lines 212. Boost converter 214 is electrically coupled to printer electronics 220 through lines 216.

AC mains 202 provide an AC voltage (e.g., 120V AC or 240V AC) to single stage power factor correction charger 206 through AC line 204. Single stage power factor correction charger 206 converts the AC voltage received on AC line 204 to provide a DC voltage on DC line 208. In one example, single stage power factor correction charger 206 provides substantially 12V DC and up to substantially 30 W on DC line 208. In other examples, single stage power factor correction charger 206 provides another suitable DC voltage on DC line 208. Single stage power factor correction charger 206 includes passive and/or active power factor correction circuitry. In one example, single stage power factor correction charger 206 has a power factor greater than 0.9 at 240V AC.

Energy storage device 218 is charged by the DC voltage on line 208 provided by single stage power factor correction charger 206. Energy storage device 218 provides power to boost converter 214 during peak load conditions of printer electronics 220. In one example, energy storage device 218 provides power to boost converter 214 during peak load conditions of printer electronics 220 lasting up to 3 seconds. In another example, during a sleep mode of the printer, single stage power factor correction charger 206 may be turned off and energy storage device 218 may be used for powering printer electronics 220 that use power during sleep mode. When the energy stored within energy storage device 218 drops below a threshold, the single stage power factor correction charger 206 is turned back on to recharge energy storage device 218.

Various buck converters 210 are DC-to-DC voltage converters that convert the DC voltage on DC line 208 to provide lower DC voltages on lines 212 for powering printer electronics 220. Boost converter 214 is a DC-to-DC voltage converter that converts the DC voltage on DC line 208 to provide a higher DC voltage on lines 216 for powering printer electronics 220.

In one example, single stage power factor correction charger 206 is a power adapter external to a printer while energy storage device 218, various buck converters 210, and boost converter 214 are internal to a printer including printer electronics 220. Single stage power factor correction charger 206 may be used with a plurality of differently sized energy storage devices 218 and therefore with a variety of different printers having different peak load power needs. As such, a universal power architecture is provided that may be used with both consumer and business printer platforms, thereby reducing design and production costs while improving performance.

Figure 3:
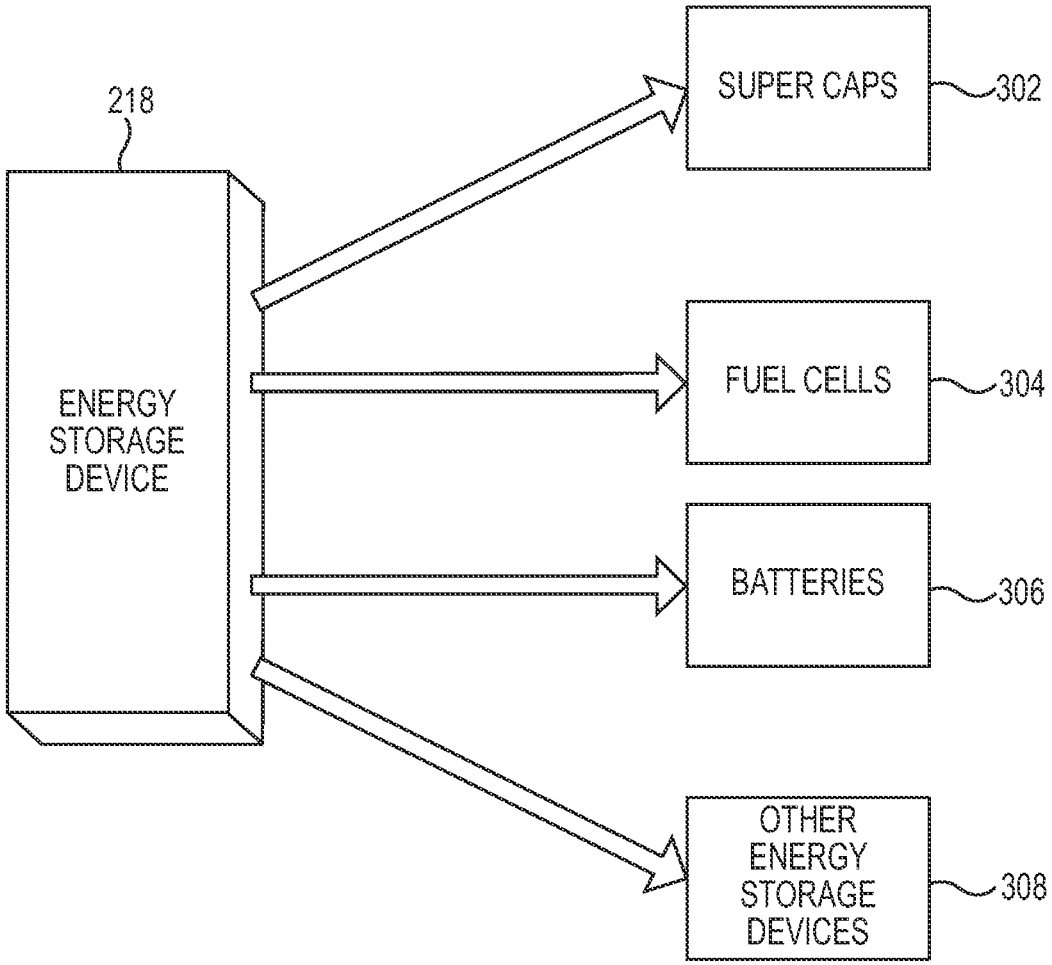
FIG. 3 is a diagram illustrating examples of energy storage devices that may be used for the energy storage device illustrated in FIG. 2.

FIG. 3 is a diagram illustrating examples of energy storage devices that may be used for energy storage device 218 illustrated in FIG. 2. Energy storage device 218 may include super capacitors 302 (i.e., electric double-layer capacitors), fuel cells 304, batteries 306, or other suitable energy storage devices 308 suitable for being charged by single stage power factor correction charger 206 and suitable for providing power to printer electronics 220 during a peak load condition. In one example, energy storage device 218 includes a suitable combination of two or more of super capacitors 302, fuel cells 304, batteries 306, and/or other suitable energy storage devices 308.

Figure 4:
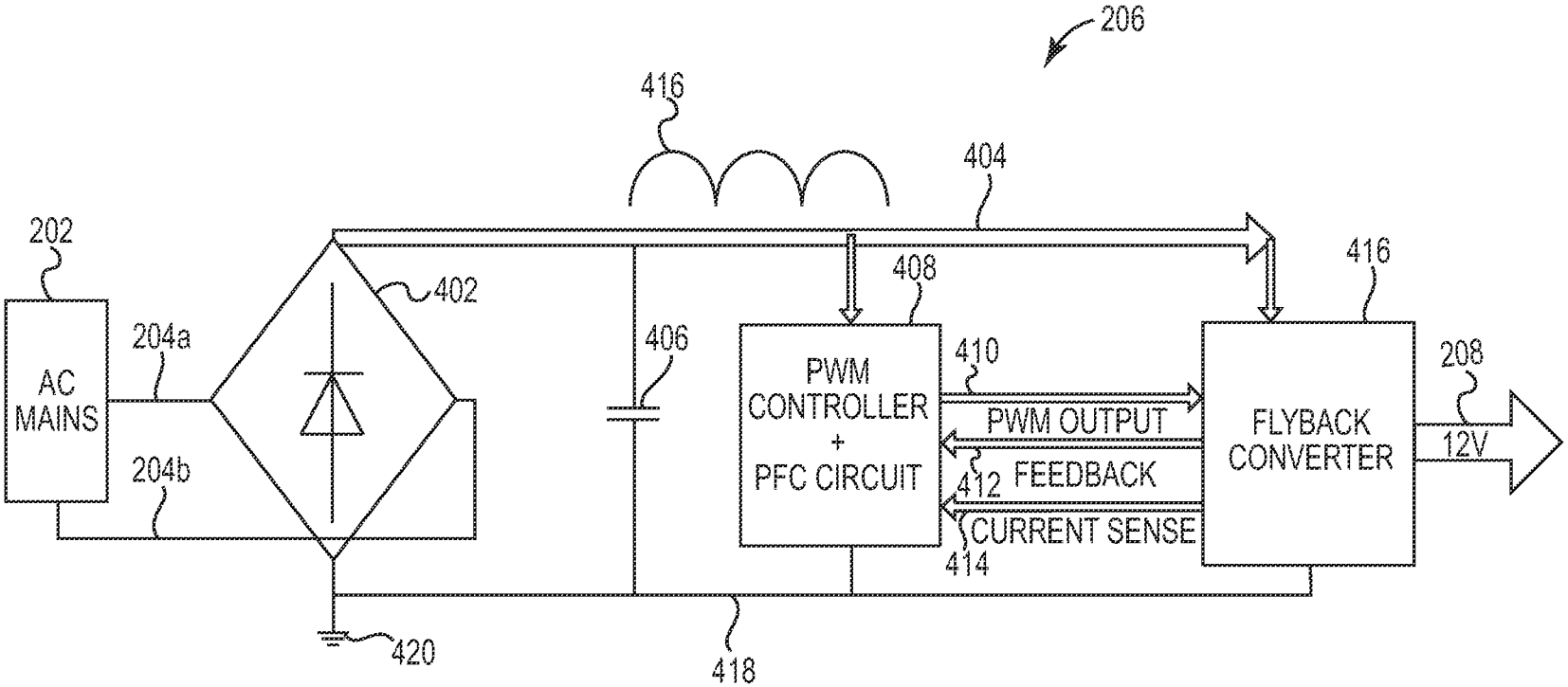
FIG. 4 is a block diagram illustrating one example of the single stage power factor correction charger illustrated in FIG. 2.

FIG. 4 is a block diagram illustrating one example of single stage power factor correction charger 206 illustrated in FIG. 2. Single stage power factor correction charger 206 includes a full wave rectifier 402, a capacitor 406, a Pulse Width Modulation (PWM) controller and Power Factor Correction (PFC) circuit 408, and a flyback converter 416. AC mains 202 are electrically coupled to inputs of full wave rectifier 402 through AC lines 204*a* and 204*b*. The output of full wave rectifier 402 is electrically coupled to one side of capacitor 406, an input of PWM controller and PFC circuit 408, and an input of flyback converter 416 through line 404. The other side of capacitor 406, full wave rectifier 402, PWM controller and PFC circuit 408, and flyback converter 416 are each coupled to a common or ground 420 through line 418. An output of PWM controller and PFC circuit 408 is electrically coupled to an input of flyback converter 416 through PWM output signal line 410. An output of flyback converter 416 is electrically coupled to an input of PWM controller and PFC circuit 408 through feedback signal line 412. Another output of flyback converter 416 is electrically coupled to another input of PWM controller and PFC circuit 408 through current sense signal line 414.

Full wave rectifier 402 receives an AC voltage on AC lines 204*a* and 204*b* from AC mains 202 and rectifies the AC voltage to provide a full wave rectified signal 416, which is smoothed by capacitor 406 through the removal of unwanted high frequency noise, on line 404 to PWM controller and PFC circuit 408 and to flyback converter 416. Capacitor 406 removes the unwanted high frequency noise on line 404. In one example, capacitor 406 is less than 1 μF.

PWM controller and PFC circuit 408 provides a PWM output signal to flyback converter 416 through PWM output signal line 410 for controlling flyback converter 416. In one example, PWM controller and PFC circuit 408 is an Application Specific Integrated Circuit (ASIC). Flyback converter 416 provides a feedback signal and a current sense signal to PWM controller and PFC circuit 408 through feedback signal line 412 and current sense signal line 414, respectively. Based on the feedback signal, PWM controller and PFC circuit 408 adjust the PWM output signal such that flyback converter 416 maintains a regulated DC voltage on DC line 208. Based on the current sense signal, PWM controller and PFC circuit 408 corrects the power factor to maintain a power factor greater than 0.9. In one example, flyback converter 416 provides a regulated 12V DC on DC line 208.

Figure 5:
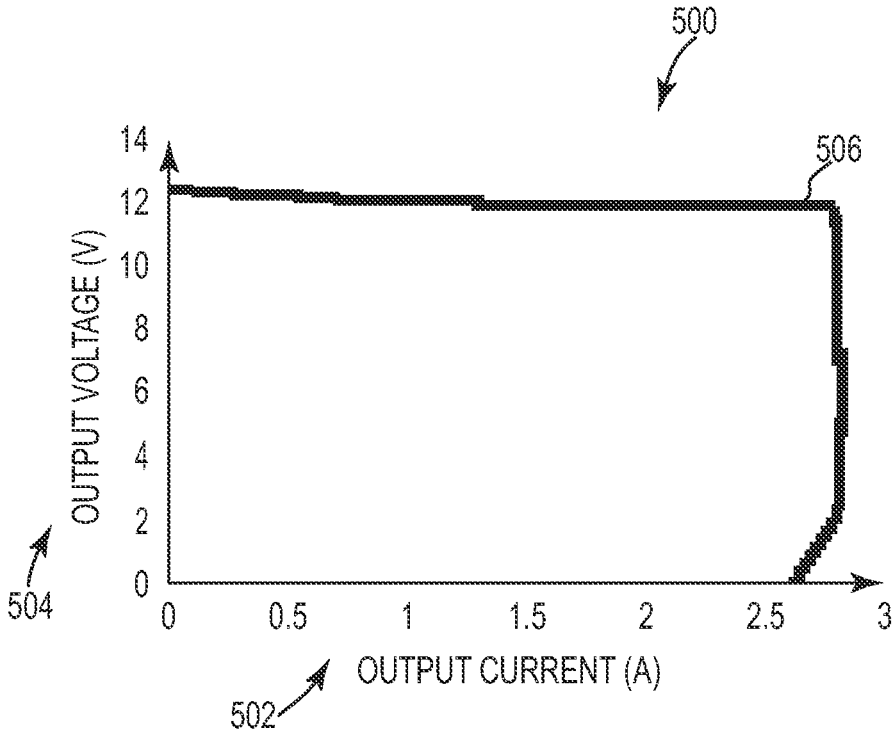
FIG. 5 is a chart illustrating one example of the output signal of the flyback converter illustrated in FIG. 4.

FIG. 5 is a chart 500 illustrating one example of the output signal 506 of flyback converter 416 illustrated in FIG. 4. Chart 500 includes output current on x-axis 502 and output voltage on y-axis 504. Flyback converter 416 outputs signal 506 having a substantially constant 12V DC up to about 2.8 A. Therefore, output signal 506 provides average power up to about 30 W.

Figure 6:
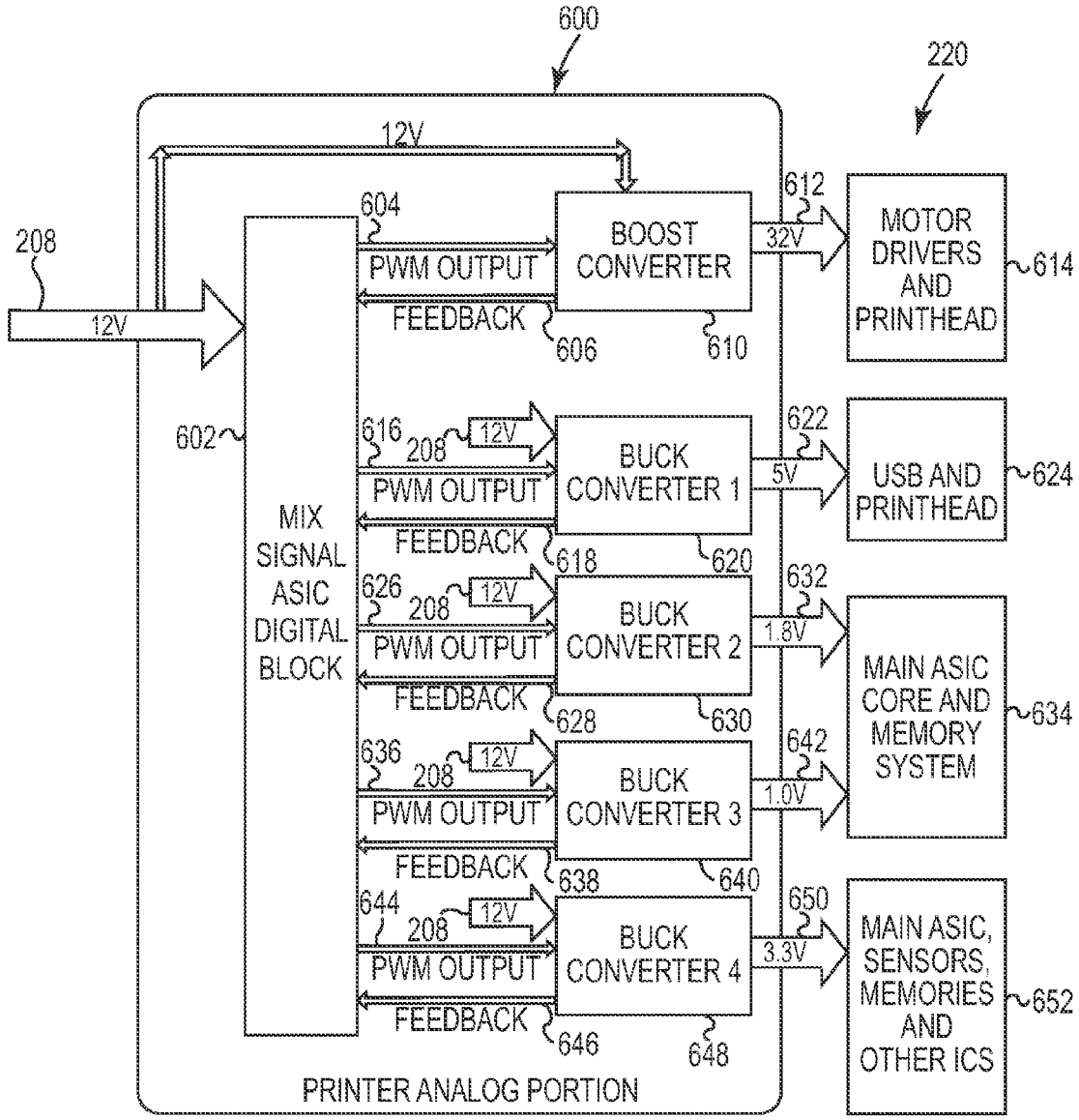
FIG. 6 is a block diagram illustrating one example of a printer analog portion and printer electronics.

FIG. 6 is a block diagram illustrating one example of a printer analog portion 600 and printer electronics 220. Printer analog portion 600 includes a mix signal ASIC digital block 602, a boost converter 610, a first buck converter 620, a second buck converter 630, a third buck converter 640, and a fourth buck converter 648. Printer electronics 220 includes motor drivers and printhead 614, Universal Serial Bus (USB) and printhead 624, main ASIC core and memory system 634, and main ASIC sensors, memories, and other Integrated Circuits (ICs) 652.

Mix signal ASIC digital block 602 is electrically coupled to boost converter 610 through PWM output signal line 604 and feedback signal line 606. Boost converter 610 is electrically coupled to motor drivers and printhead 614 through DC line 612. Mix signal ASIC digital block 602 is electrically coupled to first buck converter 620 through PWM output signal line 616 and feedback signal line 618. First Buck converter 620 is electrically coupled to USB and printhead 624 through DC line 622. Mix signal ASIC digital block 602 is electrically coupled to second buck converter 630 through PWM output signal line 626 and feedback signal line 628. Second buck converter 630 is electrically coupled to main ASIC and memory system 634 through DC line 632. Mix signal ASIC digital block 602 is electrically coupled to third buck converter 640 through PWM output signal line 636 and feedback signal line 638. Third buck converter 640 is electrically coupled to main ASIC and memory system 634 through DC line 642. Mix signal ASIC digital block 602 is electrically coupled to fourth buck converter 648 through PWM output signal line 644 and feedback signal line 646. Fourth buck converter 648 is electrically coupled to main ASIC, sensors, memories and other ICs 652 through DC line 650.

Mix signal ASIC digital block 602, boost converter 610, first buck converter 620, second buck converter 630, third buck converter 640, and fourth buck converter 648 receive 12V DC on DC line 208. Mix signal ASIC digital block 602 outputs a PWM output signal to boost converter 610 through PWM output signal line 604 for controlling boost converter 610. Boost converter 610 is a DC-to-DC voltage converter that converts substantially 12V DC to substantially 32V DC. Boost converter 610 provides a feedback signal to mix signal ASIC block 602 through feedback signal line 606. Based on the feedback signal on feedback signal line 606, mix signal ASIC digital block 602 adjusts the PWM output signal on PWM output signal line 604 such that boost converter 610 maintains a regulated 32V DC on DC line 612 to motor drivers and printhead 614.

Mix signal ASIC digital block 602 outputs a PWM output signal to first buck converter 620 through PWM output signal line 616 for controlling first buck converter 620. First buck converter 620 is a DC-to-DC voltage converter that converts substantially 12V DC to substantially 5V DC. First buck converter 620 provides a feedback signal to mix signal ASIC block 602 through feedback signal line 618. Based on the feedback signal on feedback signal line 618, mix signal ASIC digital block 602 adjusts the PWM output signal on PWM output signal line 606 such that first buck converter 620 maintains a regulated 5V DC on DC line 622 to USB and printhead 624.

Mix signal ASIC digital block 602 outputs a PWM output signal to second buck converter 630 through PWM output signal line 626 for controlling second buck converter 630. Second buck converter 630 is a DC-to-DC voltage converter that converts substantially 12V DC to substantially 1.8V DC. Second buck converter 630 provides a feedback signal to mix signal ASIC block 602 through feedback signal line 628. Based on the feedback signal on feedback signal line 628, mix signal ASIC digital block 602 adjusts the PWM output signal on PWM output signal line 626 such that second buck converter 630 maintains a regulated 1.8V DC on DC line 632 to main ASIC core and memory system 634.

Mix signal ASIC digital block 602 outputs a PWM output signal to third buck converter 640 through PWM output signal line 636 for controlling third buck converter 640. Third buck converter 640 is a DC-to-DC voltage converter that converts substantially 12V DC to substantially 1.0V DC. Third buck converter 640 provides a feedback signal to mix signal ASIC block 602 through feedback signal line 638. Based on the feedback signal on feedback signal line 638, mix signal ASIC digital block 602 adjusts the PWM output signal on PWM output signal line 636 such that third buck converter 640 maintains a regulated 1.0V DC on DC line 642 to main ASIC core and memory system 634.

Mix signal ASIC digital block 602 outputs a PWM output signal to fourth buck converter 648 through PWM output signal line 644 for control fourth buck converter 648. Fourth buck converter 648 is a DC-to-DC voltage converter that converts substantially 12V DC to substantially 3.3V DC. Fourth buck converter 648 provides a feedback signal to mix signal ASIC block 602 through feedback signal line 646. Based on the feedback signal on feedback signal line 646, mix signal ASIC digital block 602 adjusts the PWM output signal on PWM output signal line 644 such that buck converter 648 maintains a regulated 3.3V DC on DC line 650 to main ASIC sensors, memories, and other ICs 652.

In other examples, other suitable boost converters and/or buck converters providing other suitable voltages for powering printer electronics 220 are used in place of or in addition to boost converter 610 and buck converters 620, 630, 640, and 648.

Figure 7:
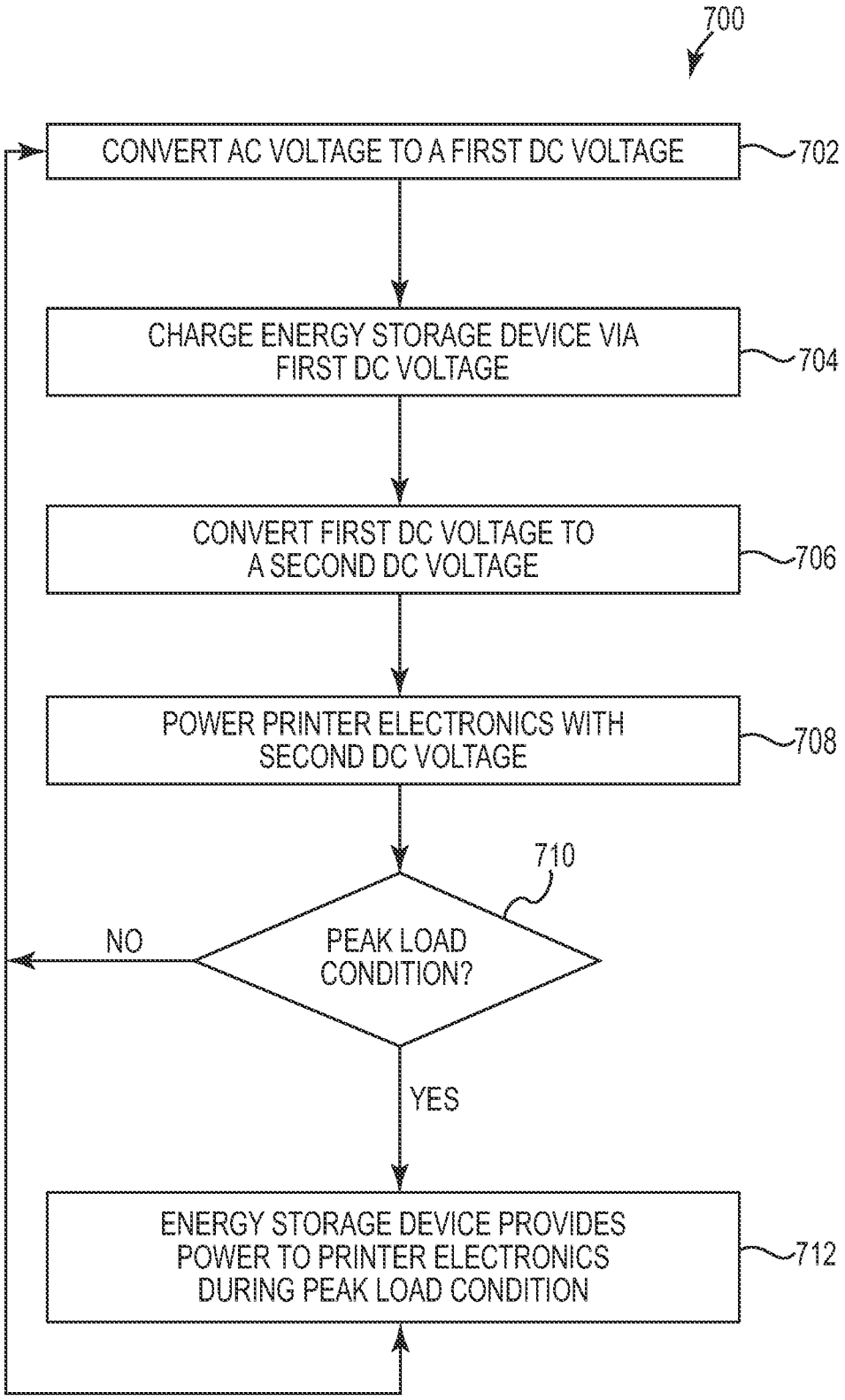
FIG. 7 is a flow diagram illustrating one example of a method for powering a printer.

FIG. 7 is a flow diagram illustrating one example of a method 700 for powering a printer. At 702, an AC voltage is converted to a first DC voltage (e.g., by single stage power factor correction charger 206 previously described and illustrated with reference to FIGS. 2 and 4). At 704, an energy storage device within the printer is charged via the first DC voltage (e.g., energy storage device 218 previously described and illustrated with reference to FIGS. 2 and 3). At 706, the first DC voltage is converted to a second DC voltage (e.g., by boost converter 214 previously described and illustrated with reference to FIG. 2 or boost converter 610 previously described and illustrated with reference to FIG. 6).

At 708, the printer electronics are powered with the second DC voltage (e.g., printer electronics 220 previously described and illustrated with reference to FIGS. 2 and 6). At 710, it is determined whether the printer is experiencing a peak load condition. A peak load condition occurs, for example, when the printer draws short term power for driving a motor or printhead. If the printer is not experiencing a peak load condition, blocks 702 through 708 are repeated. If the printer is experiencing a peak load condition, at 712 the energy storage device provides power to the printer electronics during the peak load condition. Once the peak load condition ends, blocks 702 through 708 are repeated.

Examples provide a printing system where a single power adaptor can be used with a variety of printers having different peak load needs. An energy storage device is provided in the printer to supply power to the printer electronics during peak load conditions. The power adaptor increases energy savings and provides improved power performance to provide both improved sleep mode efficiency and active mode efficiency.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A printer comprising:

an energy storage device;

a single stage power factor correction charger for charging the energy storage device and for providing a first DC voltage;

a first DC-to-DC voltage converter for converting the first DC voltage to a second DC voltage;

first printer electronics powered by the second DC voltage;

a second DC-to-DC voltage converter for converting the first DC voltage to a third DC voltage, second printer electronics powered by the third DC voltage; and a mix signal application specific integrated circuit to provide a first pulse width modulated signal to the first DC-to-DC voltage converter to control the first DC-to-DC voltage converter based on a first feedback signal from the first DC-to-DC voltage converter and to provide a second pulse width modulated signal to the second DC-to-DC voltage converter to control the second DC-to-DC voltage converter based on a second feedback signal from the second DC-to-DC voltage converter, wherein the first voltage is less than the second voltage, wherein the first voltage is greater than the third voltage, and wherein the energy storage device provides power for a peak load condition of the first printer electronics, wherein the charger comprises:

a full wave rectifier for receiving an AC voltage to provide a rectified signal;

a capacitor coupled to the full wave rectifier to remove noise from the rectified signal;

a pulse width modulation controller and power factor correction circuit coupled to the full wave rectifier and the capacitor; and a flyback converter coupled to the pulse width modulation controller and power factor correction circuit to provide the first DC voltage.

2. The printer of claim 1, wherein the energy storage device comprises one of a super capacitor, a battery, and a fuel cell.

3. The printer of claim 1, wherein the charger is within a power adaptor external to the printer, and wherein the energy storage device and the first DC-to-DC voltage converter are internal to the printer including the first printer electronics.

4. The printer of claim 1, wherein the energy storage device provides power to the second printer electronics during a sleep mode of the printer.

5. The printer of claim 1, wherein the charger provides power up to 30 watts and a power factor greater than 0.9.

6. The printer of claim 1, wherein the charger provides a power factor greater than 0.9 independent of a size of the energy storage device.

7. A printer comprising:

an energy storage device;

a single stage power factor correction charger for providing a first DC voltage and for charging the energy storage device;

a first DC-to-DC voltage converter for converting the first DC voltage to a second DC voltage, the second DC voltage greater than the first DC voltage;

first printer electronics powered by the second DC voltage;

a second DC-to-DC voltage converter for converting the first DC voltage to a third DC voltage, the third DC voltage less than the first DC voltage;

second printer electronics powered by the third DC voltage;

a mix signal application specific integrated circuit to provide a first pulse width modulated signal to the first DC-to-DC voltage converter to control the first DC-to-DC voltage converter based on a first feedback signal from the first DC-to-DC voltage converter and to provide a second pulse width modulated signal to the second DC-to-DC voltage converter to control the second DC-to-DC voltage converter based on a second feedback signal from the second DC-to-DC voltage converter;

wherein the energy storage device provides power for the first printer electronics during a peak load condition, and wherein the charger provides a power factor greater than 0.9 independent of a size of the energy storage device.

8. The printer of claim 7, wherein the charger provides power up to 30 watts.

9. The printer of claim 7, wherein the first voltage is substantially 12 volts, the second voltage is substantially 32 volts, and the third voltage is one of substantially 5 volts, substantially 1.8 volts, substantially 1.0 volts, and substantially 3.3 volts.

10. The printer of claim 7, further comprising:

a third DC-to-DC voltage converter for converting the first DC voltage to a fourth DC voltage;

third printer electronics powered by the fourth DC voltage;

a fourth DC-to-DC voltage converter for converting the first DC voltage to a fifth DC voltage;

fourth printer electronics powered by the fifth DC voltage;

a fifth DC-to-DC voltage converter for converting the first DC voltage to a sixth DC voltage; and fifth printer electronics powered by the sixth DC voltage.

11. The printer of claim 7, wherein the energy storage device provides power to the second printer electronics during a sleep mode of the printer.

12. The printer of claim 7, wherein the charger comprises:

a full wave rectifier for receiving an AC voltage to provide a rectified signal;

a capacitor coupled to the full wave rectifier to remove noise from the rectified signal;

a pulse width modulation controller and power factor correction circuit coupled to the full wave rectifier and the capacitor; and a flyback converter coupled to the pulse width modulation controller and power factor correction circuit to provide the first DC voltage.

* * * * *